US009536490B2

(12) United States Patent
Dong

(10) Patent No.: US 9,536,490 B2
(45) Date of Patent: Jan. 3, 2017

(54) DISPLAY DEVICE, DISPLAY PANEL AND DRIVING METHOD THEREOF WHICH INCLUDE APPLYING DIFFERENT COMMON VOLTAGES

(71) Applicant: Shenzhen China Star Optoelectronics Technology Co., Ltd., Shenzhen, Guangdong (CN)

(72) Inventor: Chengcai Dong, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 266 days.

(21) Appl. No.: 14/232,269

(22) PCT Filed: Jul. 9, 2013

(86) PCT No.: PCT/CN2013/079063

§ 371 (c)(1),
(2) Date: Jan. 12, 2014

(87) PCT Pub. No.: WO2015/000188

PCT Pub. Date: Jan. 8, 2015

(65) Prior Publication Data

US 2015/0015469 A1 Jan. 15, 2015

(30) Foreign Application Priority Data

Jul. 5, 2013 (CN) ..... 2013 1 0283362

(51) Int. Cl.
*G09G 3/36* (2006.01)

(52) U.S. Cl.
CPC ..... *G09G 3/3696* (2013.01); *G09G 3/3655* (2013.01)

(58) Field of Classification Search
None
See application file for complete search history.

(56) References Cited

U.S. PATENT DOCUMENTS 6,392,626 B1 * 5/2002 Moon ..... G09G 3/3655 345/92
6,567,064 B1 * 5/2003 Song ..... G02F 1/1345 345/100

(Continued)

FOREIGN PATENT DOCUMENTS

CN 1253303 A 5/2000

*Primary Examiner* — Ilana Spar
*Assistant Examiner* — Kirk Hermann
(74) *Attorney, Agent, or Firm* — Andrew C. Cheng

(57) ABSTRACT

The present invention provides a display panel and driving method thereof, and display device. The display panel includes an array substrate and a color filter substrate, disposed oppositely; the array substrate comprising a plurality of scan lines, disposed at intervals; a plurality of data line, disposed at intervals, and crossing over and isolated from the scan lines; and a plurality of pixel units, arranged in a matrix form, and driven by the scan lines and data lines; each of the pixel units further divided into at least two active areas; the color filter substrate includes at least two common electrodes, disposed correspondingly to the active areas, the at least two common electrodes applying common voltages independently. The present invention can eliminate the non-uniform luminance problem in display images and improve the display quality.

6 Claims, 3 Drawing Sheets

(56) References Cited

U.S. PATENT DOCUMENTS

| | | | | |
|---|---|---|---|---|
| 2006/0208985 | A1* | 9/2006 | Hwang | G09G 3/3655 345/92 |
| 2010/0245326 | A1* | 9/2010 | Xiao | G09G 3/3655 345/211 |

* cited by examiner

DISPLAY DEVICE, DISPLAY PANEL AND DRIVING METHOD THEREOF WHICH INCLUDE APPLYING DIFFERENT COMMON VOLTAGES

BACKGROUND OF THE INVENTION

1. Field of the Invention

The present invention relates to the field of liquid crystal displaying techniques, and in particular to a display panel and driving method thereof, and display device.

2. The Related Arts

In known technologies, the thin-film transistor liquid crystal display (TFT-LCD) mainly comprises a scan driver, a data driver and a display panel. The scan driver transmits a scan driving voltage through scan lines to the pixel units of the display panel, and the data driver transmits a data driving voltage through data lines to the pixel units of the display panel. As such, the pixel units charge and generate electrical field under the control of the scan driver and the data driver so as to use the change of the electrical field imposed on the liquid crystal molecules to change the orientation of the liquid crystal molecules. The display panel can display images through the controlling of the deflection angle of the liquid crystal molecules.

However, in known liquid crystal display device of the current technique, because the scan driving voltage attenuates due to the impedance of the transmission path to the pixel units of the display panel, a voltage difference exists among the scan driving voltages arriving at different pixel units, which leads to the occurrence of boundary lines among each active areas of the display panel. In other words, a non-uniform luminance of the display images affects the display quality.

Thus, it is desired to have a display panel and driving method thereof, and display device that overcomes the above problems.

SUMMARY OF THE INVENTION

The technical issue to be addressed by the present invention is to provide a display panel and driving method thereof, and display device to eliminate the non-uniform luminance problem in display images and improve the display quality.

The present invention provides a display panel, which comprises: an array substrate and a color filter substrate, disposed oppositely; the array substrate comprising a plurality of scan lines, disposed at intervals; a plurality of data line, disposed at intervals, and crossing over and isolated from the scan lines; and a plurality of pixel units, arranged in a matrix form, and driven by the scan lines and data lines; each of the pixel units further divided into at least two active areas; the color filter substrate comprising at least two common electrodes, disposed correspondingly to the active areas, the at least two common electrodes applying common voltages independently.

According to a preferred embodiment of the present invention, the display panel further comprises at least two scan drivers, each of the scan drivers is connected correspondingly to at least a scan line to apply a scan driving voltage to the correspondingly connected scan line, wherein the pixel units driven by the scan lines connected to each of scan drivers form an active area.

According to a preferred embodiment of the present invention, the scan lines are disposed at intervals along a first direction, the data lines are disposed at intervals along a second direction, the second direction is perpendicular to the first direction, and the common electrodes are disposed at intervals along the first direction.

According to a preferred embodiment of the present invention, the distance between the two adjacent common electrodes is smaller than or equal to the width of the scan line.

According to a preferred embodiment of the present invention, the display panel further comprises at least a data driver, the data driver is connected respectively to at least a data line to apply a data driving voltage to the correspondingly connected data line.

According to a preferred embodiment of the present invention, the common voltages applied to the at least two common electrodes are different.

The present invention provides a display device, which comprises a display panel, wherein the display panel further comprising: an array substrate and a color filter substrate, disposed oppositely; the array substrate comprising a plurality of scan lines, disposed at intervals; a plurality of data line, disposed at intervals, and crossing over and isolated from the scan lines; and a plurality of pixel units, arranged in a matrix form, and driven by the scan lines and data lines; each of the pixel units further divided into at least two active areas; the color filter substrate comprising at least two common electrodes, disposed correspondingly to the active areas, the at least two common electrodes applying common voltages independently.

According to a preferred embodiment of the present invention, the display panel further comprises at least two scan drivers, each of the scan drivers is connected correspondingly to at least a scan line to apply a scan driving voltage to the correspondingly connected scan line, wherein the pixel units driven by the scan lines connected to each of scan drivers form an active area.

According to a preferred embodiment of the present invention, the scan lines are disposed at intervals along a first direction, the data lines are disposed at intervals along a second direction, the second direction is perpendicular to the first direction, and the common electrodes are disposed at intervals along the first direction.

According to a preferred embodiment of the present invention, the distance between the two adjacent common electrodes is smaller than or equal to the width of the scan line.

According to a preferred embodiment of the present invention, the display panel further comprises at least a data driver, the data driver is connected respectively to at least a data line to apply a data driving voltage to the correspondingly connected data line.

According to a preferred embodiment of the present invention, the common voltages applied to the at least two common electrodes are different.

The present invention provides a driving method of display panel, wherein the display panel comprising an array substrate and a color filter substrate, disposed oppositely; the array substrate comprising a plurality of scan lines, disposed at intervals; a plurality of data line, disposed at intervals, and crossing over and isolated from the scan lines; and a plurality of pixel units, arranged in a matrix form, and driven by the scan lines and data lines: each of the pixel units further divided into at least two active areas; the color filter substrate comprising at least two common electrodes, disposed correspondingly to the active areas; the driving method comprises: driving active areas successively; and applying independently and successively a common voltage to the common electrodes correspondingly to the driven active areas.

According to a preferred embodiment of the present invention, the display panel further comprises at least two scan drivers, each of the scan drivers is connected correspondingly to at least a scan line respectively, the step of driving active areas successively comprises: driving the scan drivers successively so as to apply scan driving voltage to the correspondingly connected scan line.

The efficacy of the present invention is that to be distinguished from the state of the art. Based on the known display panel, the present invention designs the color filter substrate to comprise at least two common electrodes disposed correspondingly to the active areas of the array substrate and applies driving voltages independently to the at least two common electrodes so as to eliminate the non-uniform luminance problem in display images and improve the display quality.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

The following descriptions refer to embodiments and drawings of the present invention.

Figure 1:
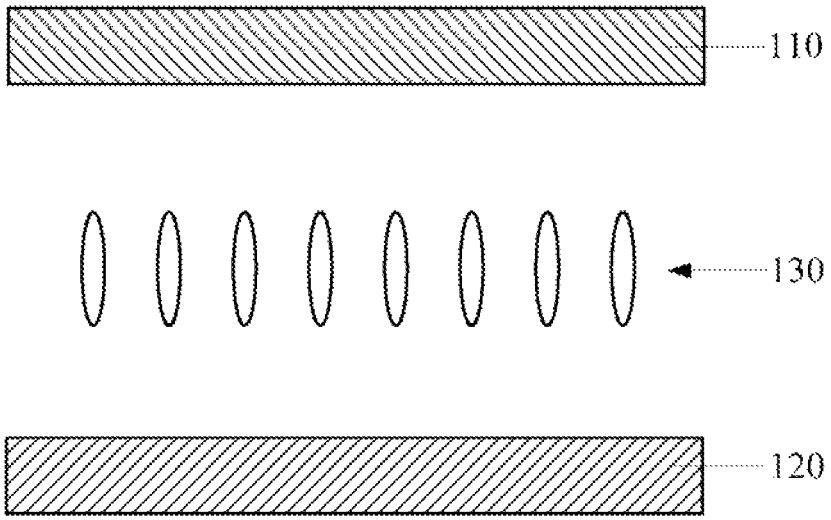
FIG. 1 is a schematic view showing the structure of a display panel of an embodiment according to the present invention.

Referring to FIG. 1, FIG. 1 is a schematic view showing the structure of a display panel of an embodiment according to the present invention. As shown in FIG. 1 the display panel of the instant embodiment comprises: an array substrate 110 and a color filter substrate 120, disposed oppositely: and a liquid crystal layer 130 sandwiched between the array substrate 110 and the color filter substrate 120.

Figure 2:
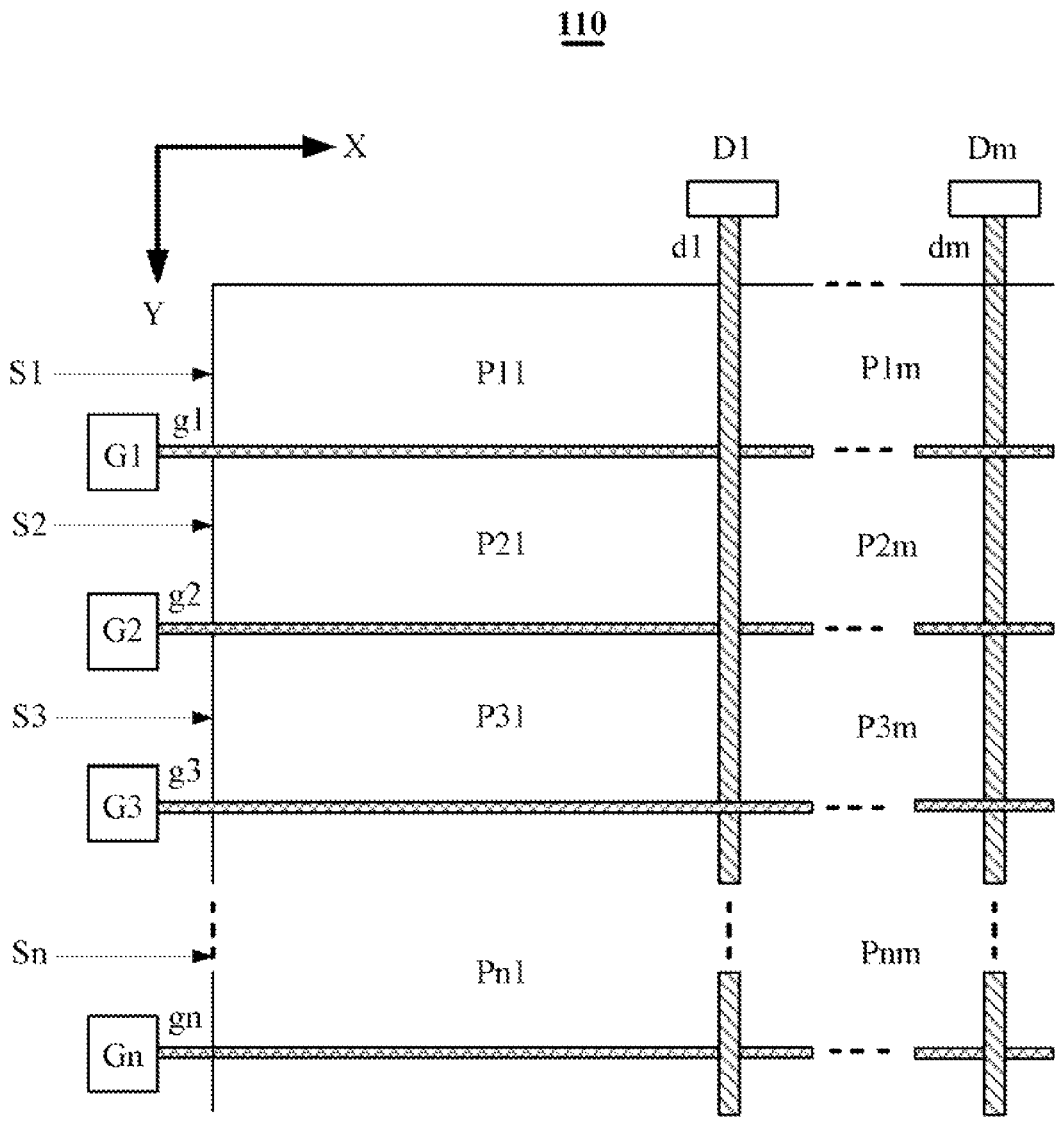
FIG. 2 is a schematic view showing the structure of the array substrate shown in FIG. 1.

FIG. 2 is a schematic view showing the structure of the array substrate 110 shown in FIG. 1. As shown in FIG. 2, the array substrate 110 comprises a plurality of scan lines g1, g2, g3, . . . gn, disposed at intervals along a first direction Y; a plurality of data line d1, . . . , dm, disposed at intervals along a second direction X, and crossing over and isolated from the scan lines g1, g2, g3, . . . , gn; scan drivers G1, G2, G3, . . . , Gn: data drivers D1, . . . , Dm; and m*n pixel units P11, P21, P31, Pn1, . . . , P1*m*, P2*m*, P3*m*, Pnm, arranged in a matrix form, and driven by the scan lines g1, g2, g3, . . . , gn and corresponding data lines d1, . . . , dm. The m and n are both positive integers.

In the instant embodiment, the first direction Y is preferably vertical direction and the second direction X is preferably horizontal direction. Each scan driver is connected correspondingly to a scan line so as to apply a scan driving voltage to the correspondingly connected scan line. The pixel units driven by the scan line connected to each scan driver forms an active area. Specifically, the scan driver G1 is connected correspondingly to the scan line g1; the scan driver G2 is connected correspondingly to the scan line g2; the scan driver G3 is connected correspondingly to the scan line g3; and the scan driver Gn is connected correspondingly to the scan line gn. The scan line g1 corresponds to the active area S1; the scan line g2 corresponds to the active area S2; the scan line g3 corresponds to the active area S3; and the scan line gn corresponds to the active area Sn.

Each data driver is connected correspondingly to a data line so as to apply a data driving voltage to the correspondingly connected data line, Specifically, the data driver D1 is connected correspondingly to the data line d1; and the data driver Dm is connected correspondingly to the data line dm.

It should be understood that in other embodiments, a scan driver can be connected correspondingly to two or more scan lines and a data driver can be connected correspondingly to two or more data lines.

Figure 3:
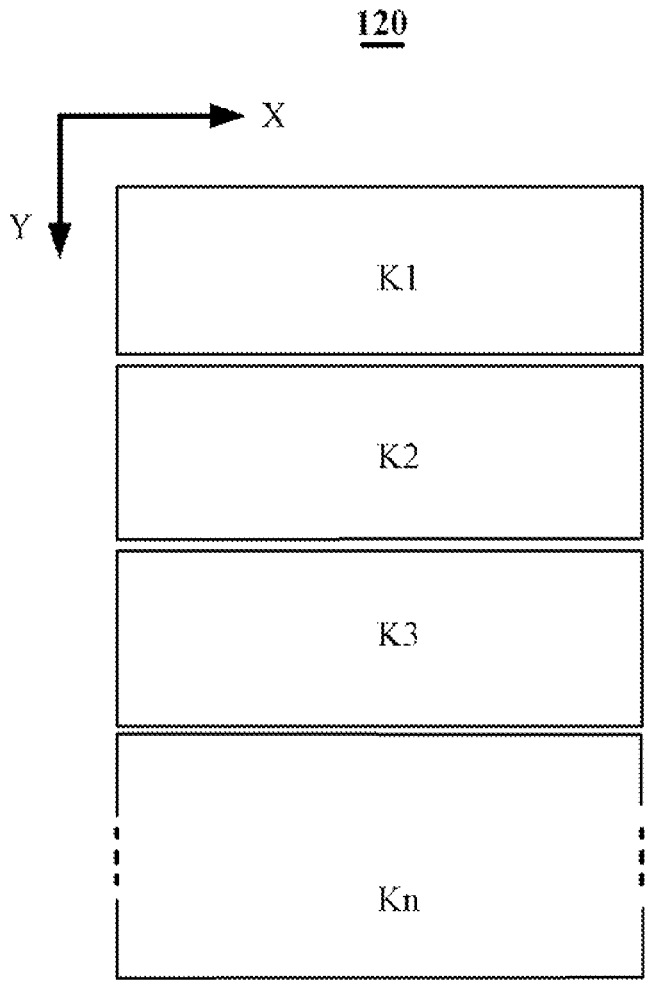
FIG. 3 is a schematic view showing the structure of the color filter substrate shown in FIG. 1.

FIG. 3 is a schematic view showing the structure of the color filter substrate shown in FIG. 1. As shown in FIG. 3, the color filter substrate 120 comprises common electrodes K1, K2, K3, . . . , Kn, disposed at intervals along the first direction Y, and corresponding respectively to the active areas S1, S2, S3, . . . , Sn of the array substrate 110. Specifically, the common electrode K1 corresponds to the active area S1; the common electrode K2 corresponds to the active area S2; the common electrode K3 corresponds to the active area S3, and the common electrode Kn corresponds to the active area Sn.

It should be noted that the common electrodes K1, K2, K3, . . . , Kn of the instant embodiment are mutually independent and can apply common voltages independently. In addition, the distance between two adjacent common electrodes is smaller than or equal to the width of the scan line so that when applying common voltage, the electrical field generated by the common electrode can completely control the deflection of the liquid crystal molecules of the liquid crystal layer of the corresponding active area.

The following refers to Figures to describe the displaying theory of the display panel of the instant embodiment according to the present invention.

The display panel is connected to external voltage and generates a first control signal through the internal timing controller to successively drive the scan drivers G1, G2, G3, . . . , Gn to apply scan driving voltage to the correspondingly connected scan lines g1, g2, g3, . . . , gn, as well as to successively drive the data drivers D1, . . . , Dm to apply data driving voltage to the correspondingly connected data lines d1, . . . , dm, which leads to transmission to the corresponding pixel units P11, P21, P31, Pn1, . . . , P1*m*, P2*m*, P3*m*, Pnm, and pixel units P11, P21, P31, Pn1, . . . , Plm, P2*m*, P3*m*, Pnm receive scan driving voltage and data driving voltage to generate electrical field to cause the liquid crystal molecules of the liquid crystal layer 130 to deflect. At this point, ae certain luminance difference exists among the active areas S1, S2, S3, Sn.

Then, the display panel generates a second control signal through the internal timing controller to successively and independently apply common voltage to the corresponding common electrodes K1, K2, K3, . . . , Kn driving the active areas S1, S2, S3, . . . , Sn so that the liquid crystal molecules of the liquid crystal layer 130 deflect again under the electrical field generated by the common electrodes K1, K2, K3, . . . , Kn. By adjusting the level of the common voltage applied to each common electrode, the liquid crystal molecules of the liquid crystal layer 130 can deflect at the same angle to eliminate the luminance difference among the active areas S1, S2, S3, . . . , Sn. For example, if the active area S1 has a luminance brighter than the active area S2, and the active area S2 has a luminance brighter than the active area S3, the common voltage applied to the common electrode K1 can be lowered to reduce the luminance of the active area S1 and the common voltage applied to the common electrodes K2, K3 can be increased to different levels to increase the luminance of the active areas S2, S3 so that the active areas S1, S2, S3 can have the same luminance to eliminate the boundary line of the luminance and improve the display quality.

It should be noted that because the luminance of each active area is different, the common voltage applied to each of the common electrodes k2, K3, . . . , Kn is also different.

The present invention also provides a display device, utilizing the display panel of the above embodiment. Therefore, the display device can eliminate the non-uniform luminance problem in display images and improve the display quality.

Figure 4:
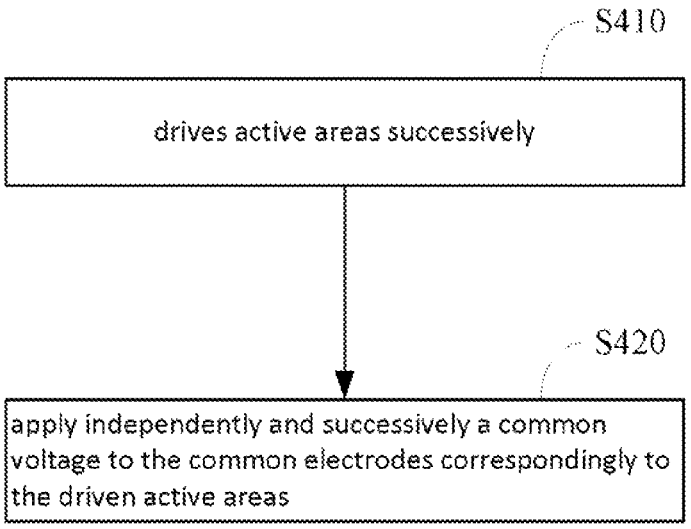
FIG. 4 is a flowchart showing a driving method of display panel of an embodiment according to the present invention.

FIG. 4 is a flowchart showing a driving method of display panel of an embodiment according to the present invention. The driving method of instant embodiment is based on the display panel of the embodiment shown in FIG. 1. The driving method comprises the following steps.

Step S410: driving active areas successively.

Specifically, the steps further comprises: driving the scan drivers of the display panel successively so as to apply scan driving voltage to the correspondingly connected scan line; and driving the data drivers of the display panel successively so as to apply data driving voltage to the correspondingly connected data line.

Step S420: applying independently and successively a common voltage to the common electrodes correspondingly to the driven active areas. The common voltage applied to each common electrode is different.

The driving method of instant embodiment is based on the display panel of the embodiment shown in FIG. 1. The specific driving process can refer to the above displaying theory of the display panel, and the description will not be repeated. The driving method of the instant embodiment can eliminate the non-uniform luminance problem in display images and improve the display quality.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A display panel, which comprises: an array substrate and a color filter substrate, disposed oppositely, wherein:

the array substrate comprising a plurality of scan lines disposed at intervals along a first direction; a plurality of data lines disposed at intervals along a second direction, the second direction is perpendicular to the first direction; and a plurality of pixel units arranged in a matrix form and driven by the scan lines and data lines; the pixel units further divided into a plurality of active areas; the color filter substrate comprising a plurality of common electrodes disposed correspondingly to the active areas, the common electrodes respectively applying different common voltages independently to the correspondingly disposed active areas; wherein, the display panel further comprises a plurality of scan drivers, each of the scan drivers is connected correspondingly to each of the scan lines respectively to apply a scan driving voltage to the correspondingly connected scan line, the pixel units driven by the same scan line connected to the same scan driver form an active area, and a distance between two adjacent common electrodes is smaller or equal to a width of the scan line of the first direction.

2. The display panel as claimed in claim 1, wherein the display panel further comprises at least a data driver, and the data driver is connected respectively to at least a data line to apply a data driving voltage to the correspondingly connected data line.

3. A display device, which comprises a display panel, wherein the display panel further comprising: an array substrate and a color filter substrate, disposed oppositely, wherein:

the array substrate comprising a plurality of scan lines, disposed at intervals along a first direction; a plurality of data lines disposed at intervals along a second direction, the second direction is perpendicular to the first direction; and a plurality of pixel units arranged in a matrix form and driven by the scan lines and data lines; the pixel units further divided into a plurality of active areas; the color filter substrate comprising a plurality of common electrodes disposed at intervals along the first direction and correspondingly to the active areas; the common electrodes respectively applying different common voltages independently to the correspondingly disposed active areas driven; wherein, the display panel further comprises a plurality of scan drivers, each of the scan drivers is connected correspondingly to each of the scan lines respectively to apply a scan driving voltage to the correspondingly connected scan line, the pixel units driven by the same scan line connected to the same scan driver form an active area, and a distance between two adjacent common electrodes is smaller or equal to a width of the scan line of the first direction.

4. The display device as claimed in claim 3, wherein the display panel further comprises at least a data driver, and the data driver is connected respectively to at least a data line to apply a data driving voltage to the correspondingly connected data line.

5. A driving method of display panel, wherein the display panel comprising: an array substrate and a color filter substrate, disposed oppositely; the array substrate comprising a plurality of scan lines disposed at intervals along a first direction; a plurality of data lines disposed at intervals along a second direction, and the second direction is perpendicular to the first direction; and a plurality of pixel units arranged in a matrix form and driven by the scan lines and data lines; the pixel units further divided into a plurality of active areas; the color filter substrate comprising a plurality of common electrodes; disposed at intervals along the first direction and correspondingly to the active areas; wherein, the display panel further comprises a plurality of scan drivers, each of the scan drivers is connected correspondingly each of the scan lines respectively, the pixel units driven by the same scan line connected to the same scan driver form an active area, and a distance between two adjacent common electrodes is smaller or equal to a width of the scan line of the first direction; the driving method comprises:

driving active areas successively; and applying independently and successively different common voltage to different common electrodes correspondingly to the active areas driven by different scan lines.

6. The driving method as claimed in claim 5, wherein the step of driving active areas successively comprises:

driving the scan drivers successively so as to apply a scan driving voltage to the correspondingly connected scan line.

* * * * *